US008590268B2

(12) United States Patent
Giles

(10) Patent No.: US 8,590,268 B2
(45) Date of Patent: Nov. 26, 2013

(54) INSTALLING UNDERLAYMENT SYSTEMS

(75) Inventor: Patrick H. Giles, Nowthen, MN (US)

(73) Assignee: Maxxon Corporation, Hamel, MN (US)

( * ) Notice: Subject to any disclaimer, the term of this patent is extended or adjusted under 35 U.S.C. 154(b) by 539 days.

(21) Appl. No.: 12/611,323

(22) Filed: Nov. 3, 2009

(65) Prior Publication Data

US 2010/0126110 A1 May 27, 2010

Related U.S. Application Data

(60) Provisional application No. 61/116,742, filed on Nov. 21, 2008.

(51) Int. Cl.
*E04B 1/00* (2006.01)
*E04G 21/00* (2006.01)
*E04G 23/00* (2006.01)

(52) U.S. Cl.
USPC ..... 52/747.11; 52/506.01; 52/35; 52/385; 52/749.11; 52/742.14

(58) Field of Classification Search
USPC ..... 52/747.11, 385, 388, 389, 742.14, 390, 52/35, 506.01, 749.11, 450, 144, 403.1, 52/280; 4/592, 661
See application file for complete search history.

(56) References Cited

U.S. PATENT DOCUMENTS 2,712,863 A * 7/1955 Busch ..... 52/79.1
3,359,574 A * 12/1967 Stoneburner ..... 4/592
4,470,227 A * 9/1984 Bigelow et al. ..... 52/79.1
4,694,627 A * 9/1987 Omholt ..... 52/390
4,744,194 A * 5/1988 Yasuyoshi ..... 52/747.11
4,837,997 A * 6/1989 Zeilinger ..... 52/280
5,140,789 A 8/1992 De Gooyer
5,424,099 A 6/1995 Stewart et al.
5,578,363 A 11/1996 Finley et al.
5,637,362 A 6/1997 Chase et al.
5,873,936 A 2/1999 Ogden
5,976,670 A * 11/1999 Fugazzi ..... 428/161
6,003,169 A 12/1999 Davis, Jr.
6,161,353 A 12/2000 Negola et al.
6,167,668 B1 1/2001 Fine et al.
6,299,970 B1 10/2001 Richards et al.
6,354,058 B1 * 3/2002 Lewis ..... 52/749.11
6,361,199 B1 3/2002 Jorgenson (Continued)

OTHER PUBLICATIONS

DensShield Tile Backer product sheet, 2 pages. www.densshield.com (Jan. 2009), GP-TM Lit. Item #532286.

*Primary Examiner* — Chi Q Nguyen
(74) *Attorney, Agent, or Firm* — Fredrikson & Byron, P.A.

(57) ABSTRACT

Methods for installing underlayment systems include the steps of laying at least one piece of a pre-formed board over at least one first portion surface area of a sub-floor. The pre-formed board is preferably fire-resistant gypsum board, which may also be water- and/or moisture-resistant. A second portion surface area of the sub-floor, which is adjacent to each first portion surface area, is designated to receive a poured underlayment after a tub is installed over the laid at least one piece of pre-formed board. In some instances, a sound mat may be laid over each first portion surface area of the sub-floor, prior to laying the at least one piece of the pre-formed board, and, then, another sound mat may be laid over the second portion surface area of the sub-floor, after laying the at least one piece of pre-formed board and prior to pouring the poured underlayment.

26 Claims, 5 Drawing Sheets

(56) References Cited

U.S. PATENT DOCUMENTS

| | | | | |
|---|---|---|---|---|
| 6,401,418 | B1 * | 6/2002 | Senn et al. | 52/506.01 |
| 6,576,577 | B1 | 6/2003 | Garner | |
| 6,599,599 | B1 * | 7/2003 | Buckwater et al. | 428/40.1 |
| 6,620,487 | B1 | 9/2003 | Tonyan et al. | |
| 6,673,177 | B2 | 1/2004 | Buckwalter et al. | |
| 6,800,361 | B2 | 10/2004 | Bruce et al. | |
| 7,096,630 | B1 | 8/2006 | Keene et al. | |
| 7,694,462 | B2 * | 4/2010 | O'Callaghan et al. | 52/35 |
| 7,827,751 | B2 * | 11/2010 | Plante | 52/403.1 |
| 7,886,488 | B2 * | 2/2011 | Payne et al. | 52/144 |
| 7,902,092 | B2 * | 3/2011 | Egan et al. | 442/42 |
| 7,908,810 | B2 * | 3/2011 | Payne et al. | 52/450 |
| 8,209,927 | B2 * | 7/2012 | Cottier et al. | 52/309.3 |
| 2002/0170648 | A1 | 11/2002 | Dinkel | |
| 2004/0018354 | A1 | 1/2004 | May | |
| 2004/0197544 | A1 | 10/2004 | Ramesh et al. | |
| 2004/0266304 | A1 | 12/2004 | Jaffee | |
| 2005/0130541 | A1 | 6/2005 | Shah | |
| 2006/0003148 | A1 | 1/2006 | Zwynenburg et al. | |
| 2006/0053739 | A1 | 3/2006 | Jaffee | |
| 2006/0096208 | A1 | 5/2006 | Turner et al. | |
| 2006/0147681 | A1 | 7/2006 | Dubey | |
| 2007/0044407 | A1 | 3/2007 | Elliott | |
| 2007/0122604 | A1 | 5/2007 | Wang et al. | |
| 2007/0289238 | A1 | 12/2007 | Payne et al. | |
| 2008/0124530 | A1 | 5/2008 | Paradis et al. | |

* cited by examiner

INSTALLING UNDERLAYMENT SYSTEMS

RELATED APPLICATION

The present application claims priority to U.S. Provisional Patent Application Ser. No. 61/116,724, which was filed on Nov. 21, 2008 and is hereby incorporated by reference.

TECHNICAL FIELD

The present invention pertains to floor construction in dwellings and more particularly to installing underlayment systems.

BACKGROUND

Underlayments that are installed over sub-floor structures can facilitate the laying of floor coverings, for example, carpet, tile, wood parquet, and vinyl, and may result in a more stable finished floor. Many pourable floor topping mixtures, which are suitable for incorporation in underlayment systems, are gypsum-based, in order to provide a level of fire protection by retarding the spread of flames. Some examples of gypsum-based floor topping mixtures include: Gyp-Crete®, Gyp-Crete 2000® and Dura-Cap®, all of which are available from Maxxon® Corporation. Gypsum-based pourable floor topping are generally installed in dwellings, which are under construction and subject to building codes that require minimum fire ratings.

Pourable floor toppings are typically installed in two stages: first, over the portions of a dwelling sub-floor where fixtures such as bath tubs are to be installed (these portions being designated as pre-pour areas); and, then, over the remainder of the sub-floor, following the installation of the fixtures. Although the pre-pour areas are relatively small compared to the remainder of the sub-floor, installation of the pourable floor topping to the pre-pour areas requires dispatching to the construction site all of the necessary equipment and crew that, subsequently, must be dispatched again, after installing the bath tubs, in order to install the remainder of the floor topping to complete the underlayment system.

BRIEF DESCRIPTION OF THE DRAWINGS

The following drawings are illustrative of particular exemplary embodiments and methods and therefore do not limit the scope of the invention. The drawings are not to scale (unless so stated) and are intended for use in conjunction with the explanations in the following detailed description. Disclosed methods will hereinafter be described in conjunction with the appended drawings, wherein like numerals denote like elements.

DETAILED DESCRIPTION

Figure 1:
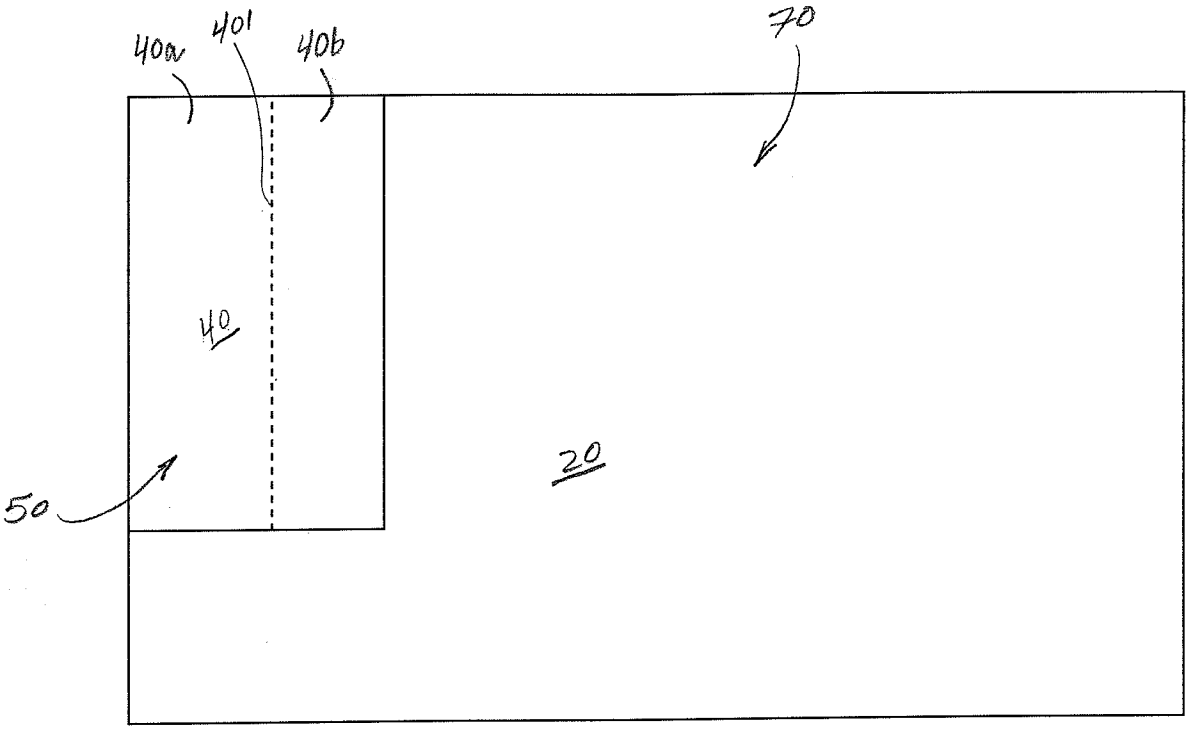
FIG. 1 is a schematic plan view of a sub-floor in accordance with some methods of the present invention.

The installation of a poured underlayment typically requires about a five to eight person crew at the construction site to prepare the pourable floor topping and to apply, or pour the mixed floor topping over the sub-floor. The equipment required at the construction site typically includes a mixing machine, which is connectable to a water source, to mix the floor topping, i.e. a gypsum-based cement slurry, and a pumping station that is connected to the mixing machine and by which the mixed topping is pumped for the pouring, or application, for example, through a flexible tube that is connected to the pumping station. About three persons may be required transport ingredients of the floor topping into the mixing machine and to operate the mixing machine, and about two to five persons may be required to apply the resulting mixture to a sub-floor, for example, by extending the flexible tube from the pumping station, outside the dwelling, and into the dwelling. As mentioned above, for those types of construction, for example, dwelling places, that include one or more bath tubs, all of the equipment and crew must be dispatched to the construction site at least two times, the first time to install a first portion of the poured underlayment over each pre-pour area of the sub-floor that will receive a tub, and the second time, after each tub is installed, in order to install a second portion of the poured underlayment over the remaining area of the sub-floor. Typically one to four weeks, or longer, may pass between installation of the poured underlayment over each pre-pour area of the dwelling and installation of the poured underlayment over the remainder of the sub-floor, depending on the construction schedule.

For multi-family dwelling places, which have a relatively large number of pre-pour areas, a larger crew may actually be required to install the first portion of the poured underlayment than to install the second portion, since the task of routing the flexible tube, from which the floor topping is applied, throughout the dwelling, for example, into and out from multiple doorways, in order to access each pre-pour area for each unit of the dwelling place, can require more man-power to manage. According to methods of the present invention, which will be described in detail below, a crew of only one to two persons may be required to install one or pieces of a pre-formed board over each pre-pour area of the sub-floor, in lieu of the pourable floor topping mix. Once installed, the pre-formed board, that covers the pre-pour area of the sub-floor, and the poured floor topping mix, that covers the remaining area of the sub-floor, together form an underlayment for a floor of a dwelling that is comparable to the wholly poured underlayment, yet has saved a significant amount of installation time and expense.

The following detailed description is exemplary in nature and is not intended to limit the scope, applicability, or configuration of the invention in any way. Rather, the following description provides practical illustrations for practicing exemplary methods of the present invention. Those skilled in the art will recognize that many of the examples provided have suitable alternatives that can be utilized.

FIG. 1 is a schematic plan view of a sub-floor 20, which may be defined by a deck (e.g. plywood or metal) supported by underlying joists; sub-floor 20 is shown divided into a first portion surface area 50 and a second portion surface area 70, in accordance with some methods of the present invention. According to methods of the present invention, first portion surface area 50 has a size approximately equal to a footprint of a fixture, for example, a bath tub, and may be designated as a pre-pour area over which at least one piece of a pre-formed board 40 is laid, prior to installing the fixture. Second portion surface area 70 is shown being located adjacent to first portion surface area 50, making up a remainder of sub-floor 20, and, according to methods of the present invention, is left substantially exposed for the installation of a poured underlayment thereover, the underlayment being formed, for example, by one of the floor topping mixtures described above. A sub-floor of a dwelling is typically divided among various rooms, and, particularly in a multi-family dwelling, has multiple pre-pour, or first portion surface areas, so that, although FIG. 1 is simplified to show second portion surface area 70 undivided and only the one first portion surface area 50, it should be understood that methods of the present invention preferably apply to the typical sub-floors and may be particularly advantageous for sub-floors of multi-family dwellings.

FIG. 1 illustrates the at least one piece of the board 40 comprising a first piece 40*a* and second piece 40*b*, but either a single piece or more than two pieces of the board 40 may be employed, according to alternate methods, so long as substantially an entirety of first portion surface area 50 is covered by the board 40. Pieces 40*a*, 40*b* are shown placed edge-to-edge, in order to cover first portion surface area 50, and a seam 401, which is shown located along the abutting edges, may be patched as will be described below. According to methods of the present invention, the at least one piece of the board 40 is installed over sub-floor 20 rather than pouring a floor topping mix over first portion surface area 50.

Pre-formed board 40 may be any board that is solid, or rigid, at the time of installation, but is preferably a fire resistant gypsum board having a nominal thickness of ⅝ inch, for example, manufactured in accordance with ASTM standards that define Type X gypsum wall board. Commercially available examples of such board include, without limitation, DensShield® and DensGlass™ from Georgia-Pacific. Pre-formed board 40 is also, preferably, water- and/or moisture-resistant, for example, having a water-resistant core and/or surface coating that retards moisture transmission into the board, like DensShield®.

Figure 2B:
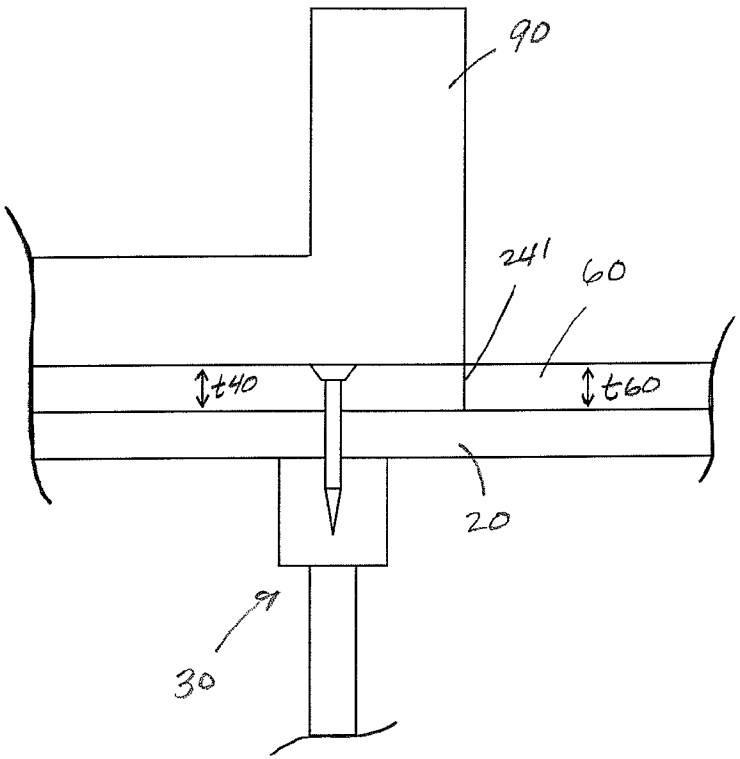
FIGS. 2A-B are schematic section views, according to a first group of methods.
Figure 2A:
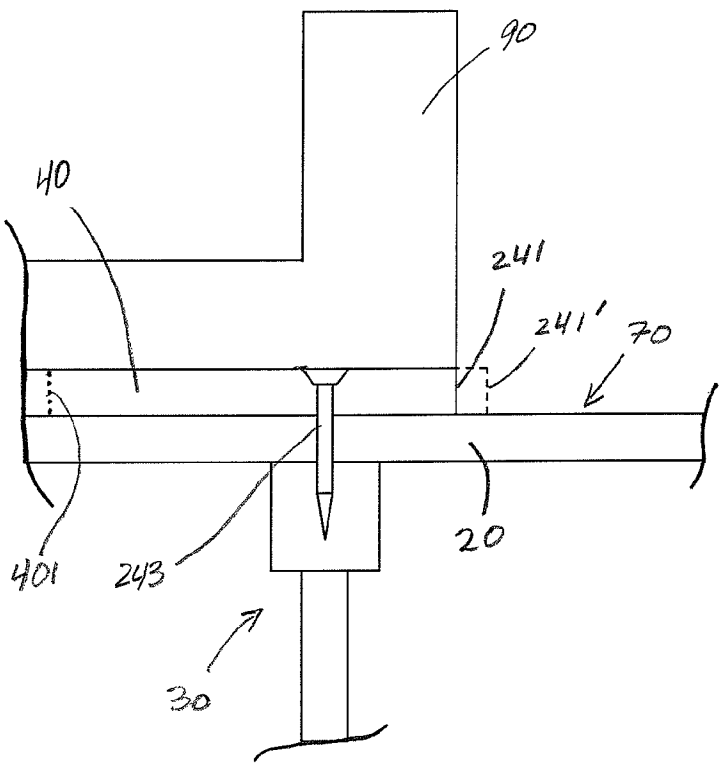

FIG. 2A is a schematic section view of sub-floor 20, according to a first group of methods, wherein sub-floor 20 has been prepared for installation of the poured underlayment over second portion 70. FIG. 2A illustrates the at least one piece of the pre-formed board 40 having been laid over first portion surface area 50 and then secured to sub-floor 20 via a mechanical fastener 243, which is shown extending into a joist 30. A plurality of mechanical fasteners, for example, either nails or screws, may be used to secure the at least one piece of the pre-formed board 40, and, according to alternate embodiments, the pre-formed board 40 may be secured to sub-floor 20 via any suitable adhesive, either independently of, or in conjunction with one or more mechanical fasteners.

FIG. 2A further illustrates a bath tub 90 which has been installed over the at least one piece of the pre-formed board 40, following the fastening of the board 40 to sub-floor 20. With reference back to FIG. 1, it should be understood that bath tub 90 has a footprint that is approximately equal to the size of first portion surface area 50, over which the at least one pre-formed board 40 is laid. According to some methods, the surface area of the at least one pre-formed board 40, when laid, is slightly larger than a footprint of tub 90, for example, as shown by the dashed lines in FIG. 2A, so that an edge 241' of the board 40 is exposed following the installation of the tub 90. If this is the case, according to some preferred methods, edge 241' is trimmed back to a trimmed exposed edge 241 that is approximately flush with an edge of tub 90. Referring back to FIG. 1, first and second pieces 40*a*, 40*b* may be used rather than a single piece of the pre-formed board 40 in order to utilize pieces of the pre-formed board 40 that are not large enough to cover an entirety of first portion surface area 50, thereby reducing scrap and eliminating waste. Seam 401 may be patched with any appropriate material, for example, preferably with a gypsum-based compound such as Gyp-Crete®, prior to installing tub 90.

FIG. 2B is a schematic section view wherein a pourable floor topping mixture has been poured over second portion surface area 70 of sub-floor 20 so as to form a poured underlayment 60 that abuts edge 241 of the at least one piece of the laid pre-formed board 40 and, preferably, adheres thereto. The floor topping mixture that forms poured underlayment 60 is preferably gypsum-based, examples of which include, without limitation, Gyp-Crete®, Gyp-Crete 2000® and Dura-Cap®, all available from Maxxon® Corporation. The term "pour" is used broadly herein to encompass any suitable method for applying the topping mixture so that the mixture is directed to flow, or spread, over sub-floor 20. According to some methods of the present invention, second portion surface area 70 is primed, following the installation of tub 90 and prior to pouring. Surface area 70 is preferably primed by applying a primer, for example, via spraying or rolling, according to methods known to those skilled in the art. One suitable primer is an EVA primer, for example, available in powdered or liquid form from Maxxon® Corporation. Primer may applied to edge 241 as well.

With further reference to FIGS. 2A-B, once the poured underlayment 60 hardens, a thickness t60 of the poured underlayment 60 is approximately equal to a thickness t40 of the laid board 40. According to some preferred configurations resulting from the group of methods illustrated in FIGS. 2A-B, thicknesses t60 and t40 are between approximately ½ inch and approximately 1 inch, for example, thickness t60 being approximately ¾ inch and thickness t40 being approximately ⅝ inch. It should be noted that alternate embodiments of the invention are not limited to these exemplary thicknesses, since thicknesses t60, t40 depend upon both the materials employed (for the pre-formed board 40 and the poured underlayment 60) in conjunction with the construction requirements for a particular project. For example, the illustrated configuration, according to the exemplary thicknesses, when employing the aforementioned DensShield® gypsum board and Gyp-Crete® floor topping, may be a listed by the Underwriters Laboratories as an approved design for compliance with one or more fire related building standards.

Figure 3B:
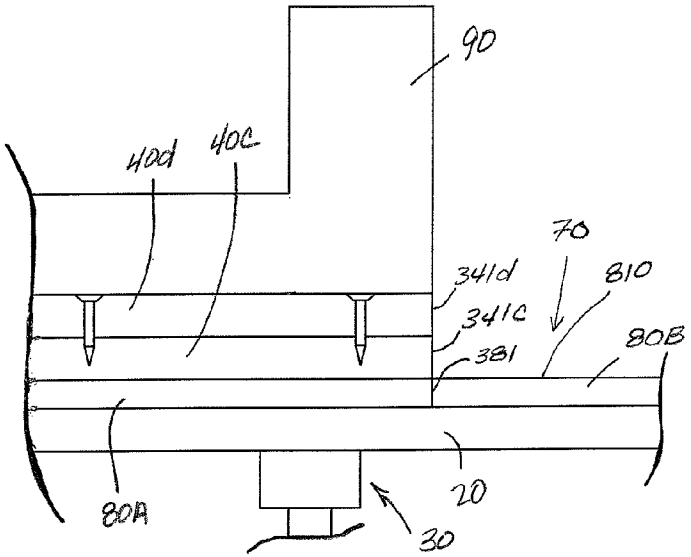
FIGS. 3A-C are schematic section views, according to a second group of methods.
Figure 3C:
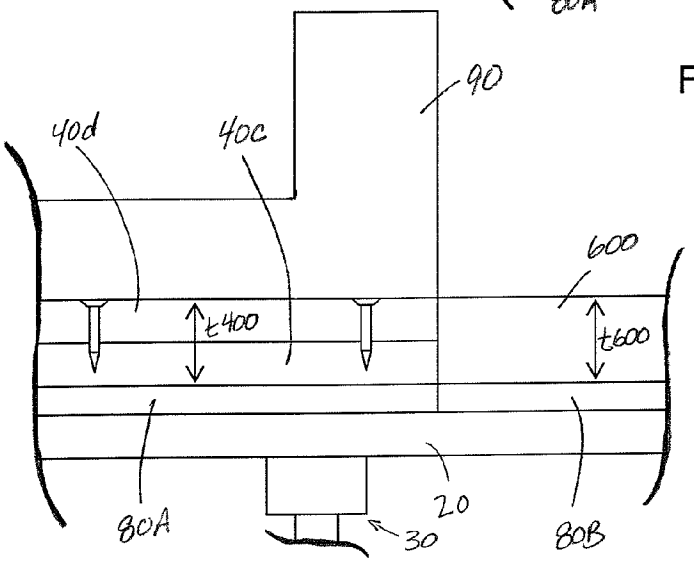
Figure 3A:
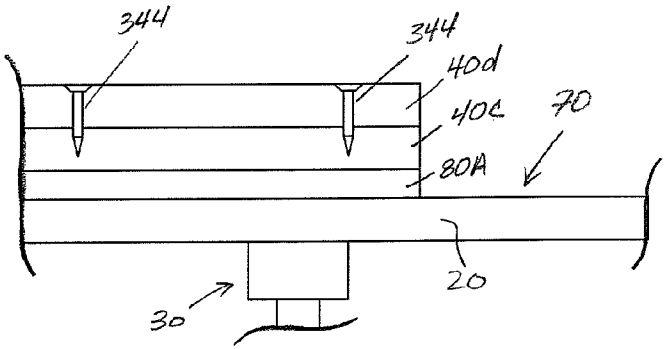

FIGS. 3A-B are schematic section views of sub-floor 20 that illustrate the preparation of sub-floor 20 for installation of poured underlayment 60, according to a second group of methods, in order to provide a level of sound control. FIG. 3A illustrates a first sound mat 80A having been laid, preferably loose laid, over first portion surface area 50, prior to laying the at least one piece of the pre-formed board 40, such that mat 80A extends between first portion surface area 50 and the pre-formed board 40. According to the illustrated embodiment, the at least one piece of the pre-formed board 40 includes a first piece 40*c* overlaid by a second piece 40*d*, wherein the first and second pieces 40*c*, 40*d* are secured together via fasteners 344. According to some alternate embodiments, any suitable adhesive may be used, either independently or in conjunction with fasteners 344, to secure pieces 40*c*, 40*d* together. FIG. 3B illustrates tub 90 having been installed over first and second pieces 40*c*, 40*d* of the board 40 and mat 80A.

FIG. 3B further illustrates a second sound mat 80B having been laid, preferably loose laid, over second portion surface area 70 of sub-floor 20 so as to abut edge 381 of first mat 80A. An exposed surface 810 of second mat 80B may be primed, for example, using a primer similar to that described above in conjunction with FIG. 2A, after installing tub 90 and prior to pouring a pourable floor topping mixture over second portion surface area 70.

With reference back to FIG. 1, it should be understood that first sound mat 80A is laid to cover substantially an entirety of first portion surface area 50, and second sound mat 80B is laid to cover substantially an entirety of second portion surface area 70. Each edge 341*c*, 341*d*, 381 of first piece 40*c*, second piece 40*d* and mat 80*a*, respectively, is shown to be approximately flush with the edge of tub 90, wherein any or all of edges 341*c*, 341*d*, 381 may have been trimmed either prior to, or following the installation of tub 90. However, according to some alternate embodiments, first sound mat 80A may extend beyond first portion surface area 50 and into second portion surface area 70 such that second mat 80B covers a smaller area and abuts edge 381 at a location within second portion surface area 70 that is offset from tub 90. The bulk material for sound mats 80A, 80B may supplied in rolls and have adhesive-backed edges for overlapping with one another to secure the abutting edges of sections of mats 80A, 80B together; alternately a separate tape material may be used for this purpose. Sound mats 80A, 80B may be formed from fused entangled filaments of a nylon material attached to a non-woven nylon fabric, or from blends of polymeric fibers having a nylon reinforcement. Examples of the former include Acousti-Mat®II and Acousti-Mat®3, and an example of the latter is Acousti-Mat®LPR, all of which are available from Maxxon® Corporation.

FIG. 3C is a schematic section view wherein a pourable floor topping mixture, for example, as described above for poured underlayment 60, has been poured over second portion surface area 70 of sub-floor 20 so as to form a poured underlayment 600 that extends over second sound mat 80B and abuts edges 341*c*, 341*d* of the at least one piece of the laid pre-formed board 40. Once the poured underlayment 600 hardens, a thickness t600 of the poured underlayment 60 is approximately equal to the combined thickness t400 of the laid pieces 40*c*, 40*d* of the pre-formed board 40. According to some preferred configurations resulting from the group of methods illustrated in FIGS. 3A-C, thicknesses t600 and t400 are greater than 1 inch, for example, being two times an approximate ⅝ inch thickness of each piece of the board 40 (approximately 1 and ¼ inch). The illustrated two layers of the board 40 may provide a stiffer support for tub 90, particularly if one or both of pieces 40*c*, 40*d* are divided into sub-pieces; and, if each of pieces 40*c* 40*d* are composed of two or more sub-pieces placed edge-to-edge over first portion surface area 50, the sub-pieces of piece 40*d* are preferably laid so as to extend over, or bridge, every seam formed by abutting edges of the underlying sub-pieces of piece 40*c*. However, according to some alternate embodiments, if a thickness of poured underlayment 600 is reduced to ¾ inch, a single layer of at least one ⅝ inch thick piece of the board 40 may be substituted for pieces 40*c*, 40*d*. As mentioned above, material selection according to the construction requirements for a particular project will dictate thicknesses of the pre-formed board 40 and poured underlayment 600, so that embodiments of the present invention are not necessarily limited to the exemplary thicknesses disclosed herein.

Figure 4:
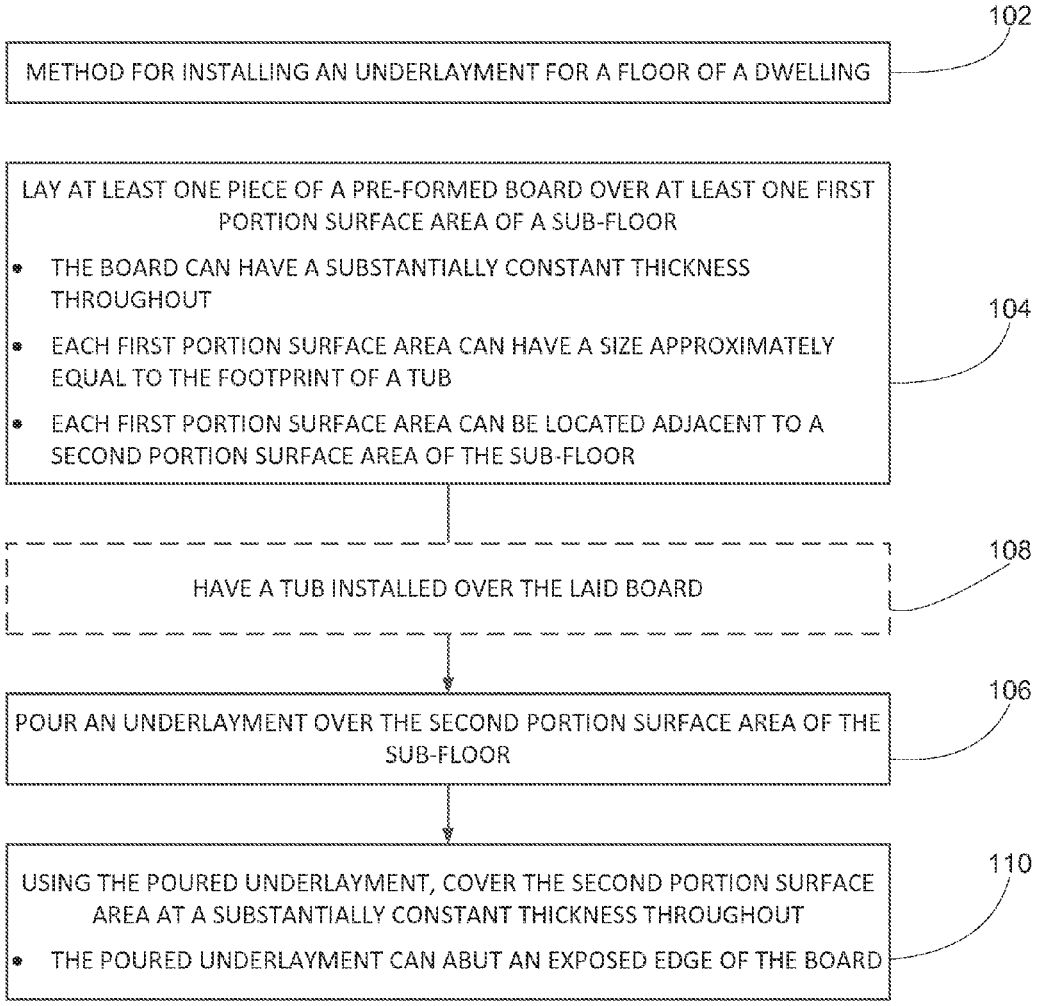
FIG. 4 is a block diagram showing a method according to some embodiments of the present invention.
Figure 5:
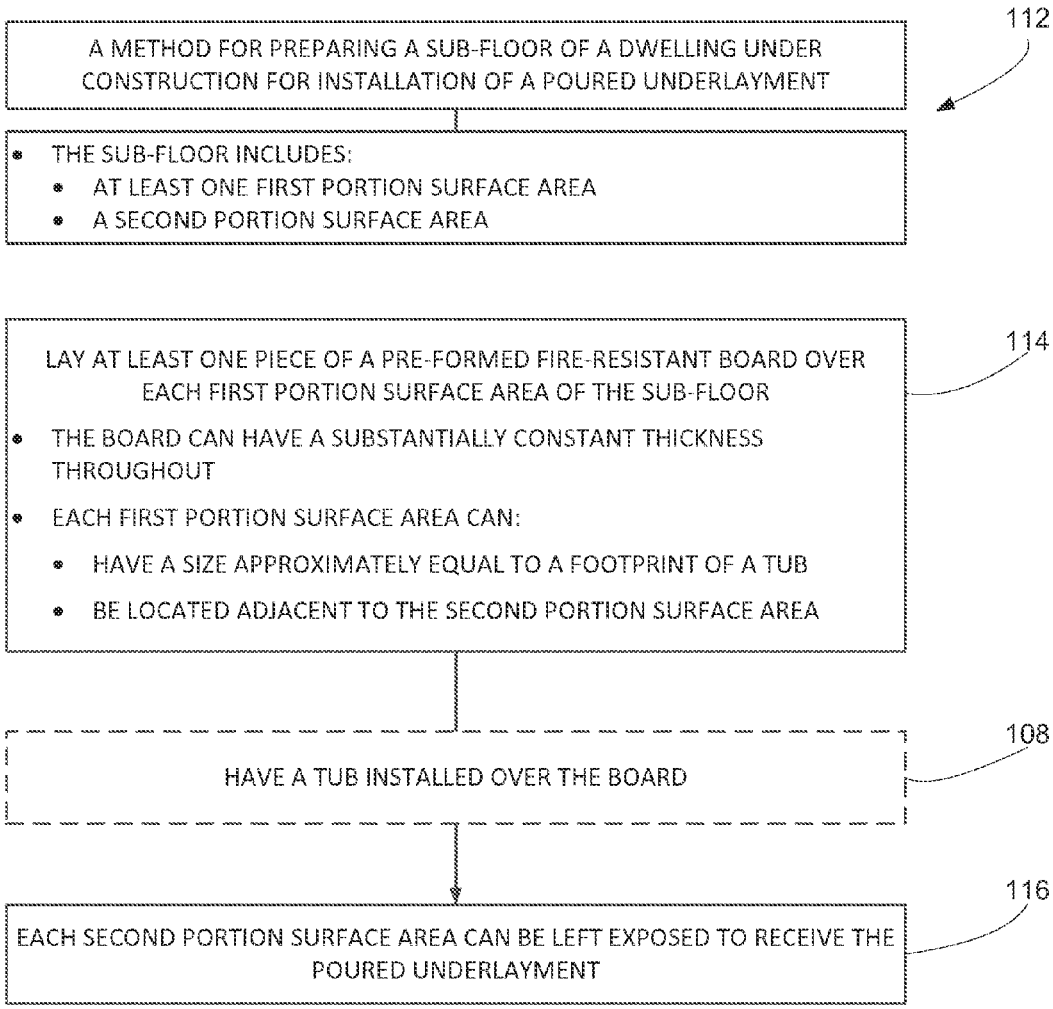
FIG. 5 is a block diagram showing a method according to some embodiments of the present invention.

FIGS. 4 and 5 are block diagrams that diagrammatically show two methods according to some embodiments. In FIG. 4, a first method 102 is depicted. The first method 102 can include a first step 104, which can include laying at least one piece of a pre-formed board over at least one first portion surface area of a sub-floor. The first method 102 can also include a second step 106, which can include pouring an underlayment over the second portion surface area of the sub-floor. The second step 106 taking place after a tub has been installed over the at least one piece of the pre-formed board, which is depicted as action 108. The first method 102 can include a third step 110, which can include using the poured underlayment to cover the second portion surface area at a substantially constant thickness throughout.

In FIG. 5, a second method 112 is depicted according to some embodiments. The second method 112 can include a step one 114, which can include laying at least one piece of a pre-formed fire-resistant board over each first portion surface area of the sub-floor. The second method 112 can also include a step two 116, which can include leaving exposed each second portion surface area to receive the poured underlayment. Step two 116 taking place after a tub has been installed over the at least one piece of the pre-formed board, which is depicted as action 108.

In the foregoing detailed description, the invention has been described with reference to specific embodiments. However, it may be appreciated that various modifications and changes can be made without departing from the scope of the invention as set forth in the appended claims.

The invention claimed is:

1. A method for installing an underlayment for a floor of a dwelling, the method comprising:

laying at least one piece of a pre-formed board having a top surface and side edge over at least one first portion surface area of a sub-floor, the board having a substantially constant thickness throughout, each first portion surface area having a size approximately equal to a footprint of a tub and being located adjacent to a second portion surface area of the sub-floor; and subsequent to installing the tub over the top surface of the at least one piece of pre-formed board, pouring an underlayment over the second portion surface area of the sub-floor to cover the second portion surface area at a substantially constant thickness throughout, wherein pouring the underlayment comprises pouring the underlayment so the underlayment abuts the side edge of the at least one piece of board.

2. The method of claim 1, wherein the at least one piece of the pre-formed board comprises a plurality of pieces, and laying the plurality of pieces comprises placing the pieces edge-to-edge to cover each first portion surface area of the sub-floor.

3. The method of claim 2, further comprising patching a seam between adjacent edges of the plurality of pieces of the pre-formed board, after laying the plurality of pieces and before the tub is installed.

4. The method of claim 1, further comprising securing the at least one piece of the pre-formed board to the sub-floor, after laying the at least one piece and before the tub is installed.

5. The method of claim 1, further comprising priming the second portion surface area of the sub-floor, after the tub is installed and before pouring the underlayment.

6. The method of claim 1, further comprising laying a sound mat over each first portion surface area of the sub-floor, prior to laying the at least one piece of the pre-formed board, such that the sound mat extends between the first portion surface area and the at least one piece of the laid pre-formed board.

7. The method of claim 6, wherein the at least one piece of the pre-formed board comprises a first piece and a second piece, the first piece being laid directly over the sound mat and the second piece being laid over the first piece, such that the first piece of the pre-formed board extends between the sound mat and the second piece of the pre-formed board.

8. The method of claim 7, further comprising securing the first piece of the pre-formed board to the second piece of the pre-formed board, before the tub is installed.

9. The method of claim 6, further comprising laying another sound mat over the second portion surface area of the sub-floor, after the tub is installed and before pouring the underlayment, so that other the sound mat extends between the second portion surface area and the poured underlayment.

10. The method of claim 9, further comprising priming a surface of the other sound mat, the primed surface being that which interfaces with the poured underlayment.

11. The method of claim 1, wherein the pre-formed board is fire-resistant and water-resistant.

12. The method of claim 1, wherein the dwelling is a multi-family dwelling and the at least one first portion surface area comprises a plurality of first portion surface areas.

13. A method for preparing a sub-floor for installation of a poured underlayment, the sub-floor including at least one first portion surface area and a second portion surface area, the sub-floor being part of a dwelling under construction, and the method comprising laying at least one piece of a pre-formed fire-resistant board having a top surface and an exposed edge over each first portion surface area of the sub-floor, the board having a substantially constant thickness throughout, each first portion surface area having a size approximately equal to a footprint of a tub and being located adjacent to the second portion surface area, each second portion surface area being left exposed to receive the poured underlayment thereover, wherein laying the at least one piece of pre-formed fire-resistant board over each first portion comprising laying the at least one piece of pre-formed fire-resistant board with the exposed edge facing the second portion surface area such that, when an underlayment is poured over the second portion surface area subsequent to installing the tub over the top surface of the at least one piece of the board, the underlayment abuts the exposed edge of the at least one piece of pre-formed fire-resistant board.

14. The method of claim 13, wherein the at least one piece of the pre-formed board comprises a plurality of pieces of the board, and laying the plurality of pieces comprises placing the pieces edge-to-edge to cover each first portion surface area of the sub-floor.

15. The method of claim 14, further comprising patching a seam between adjacent edges of the plurality of pieces of the board, after laying the plurality of pieces.

16. The method of claim 13, further comprising securing the at least one piece of the pre-formed board to the sub-floor, after laying the at least one piece.

17. The method of claim 13, further comprising priming the second portion surface area of the sub-floor, after laying the at least one piece of the pre-formed board, to receive the poured underlayment.

18. The method of claim 13, further comprising trimming an exposed edge of the at least one piece of the laid pre-formed board, after the tub is installed, such that the trimmed exposed edge is approximately flush with an edge of the installed tub.

19. The method of claim 13, further comprising laying a sound mat over each first portion surface area of the sub-floor, prior to laying the at least one piece of the pre-formed board, such that the sound mat extends between each first portion surface area and the at least one piece of the laid board.

20. The method of claim 19, wherein the at least one piece of the pre-formed board comprises a first piece and a second piece, the first piece being laid directly over the sound mat and the second piece being laid over the first piece, such that the first piece of the board extends between the sound mat and the second piece of the board.

21. The method of claim 20, further comprising securing the first piece of pre-formed board to the second piece of the pre-formed board.

22. The method of claim 19, further comprising trimming an exposed edge of at least one of: the sound mat, the first piece of the pre-formed board and the second piece of the pre-formed board, after the tub is installed, such that the trimmed exposed edge is approximately flush with an edge of the installed tub.

23. The method of claim 19, further comprising laying another sound mat over the second portion surface area of the sub-floor, after laying the at least one piece of the pre-formed board.

24. The method of claim 23, further comprising priming the exposed surface of the other sound mat to receive the poured underlayment.

25. The method of claim 13, wherein the pre-formed fire-resistant board is also water-resistant.

26. The method of claim 13, wherein the sub-floor is part of a multi-family dwelling, and the at least one first portion surface area comprises a plurality of first portion surface areas.

* * * * *